US006750731B2

(12) United States Patent
Emanuelsson

(10) Patent No.: US 6,750,731 B2
(45) Date of Patent: Jun. 15, 2004

(54) CIRCULATOR AND NETWORK

(75) Inventor: Thomas Emanuelsson, Västra Frölunda (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 132 days.

(21) Appl. No.: 10/095,260

(22) Filed: Mar. 11, 2002

(65) Prior Publication Data

US 2002/0135434 A1 Sep. 26, 2002

(30) Foreign Application Priority Data

Mar. 23, 2001 (SE) ..... 0101042

(51) Int. Cl.[7] ..... H01P 1/387
(52) U.S. Cl. ..... 333/1.1; 333/24.2
(58) Field of Search ..... 333/1.1, 24.2

(56) References Cited

U.S. PATENT DOCUMENTS 5,153,537 A 10/1992 Desmarest ..... 333/1.1
5,898,346 A * 4/1999 Kamei et al. ..... 333/1.1
6,472,960 B1 * 10/2002 Ishikawa et al. ..... 333/204

FOREIGN PATENT DOCUMENTS

EP 0446107 A1 9/1991
EP 0917197 A2 5/1999
JP 55-77203 A 6/1980
JP 26268414 A 9/1994
WO WO 00/79845 A1 12/2000

OTHER PUBLICATIONS

International–Type Search Report, Search Request No. SE 01/00395, Nov. 9, 2001, pp. 1–4.

* cited by examiner

*Primary Examiner*—Robert Pascal
*Assistant Examiner*—Stephen E. Jones

(57) ABSTRACT

Circulator unit comprising a first member (1) in a first dielectric layer (3) and a second member (2) in second dielectric layer (4) both members being of ferro-electric material and arranged adjacent to one another, a conductive circulator pattern (10) printed on the first or second member and arranged between the first and the second member. The first substrate extends beyond the second substrate on an area where a first set of terminals is provided rendering the first set of terminals accessible. The second member extends beyond the first member on an area where a second set of terminals is provided rendering the second set of terminals accessible. The unit comprises first (7) and second ground (8) conductors arranged on each side of the first and second members and furthermore comprises at least one magnet (5, 6) or coil for providing magnetic field through the first and second member.

17 Claims, 5 Drawing Sheets

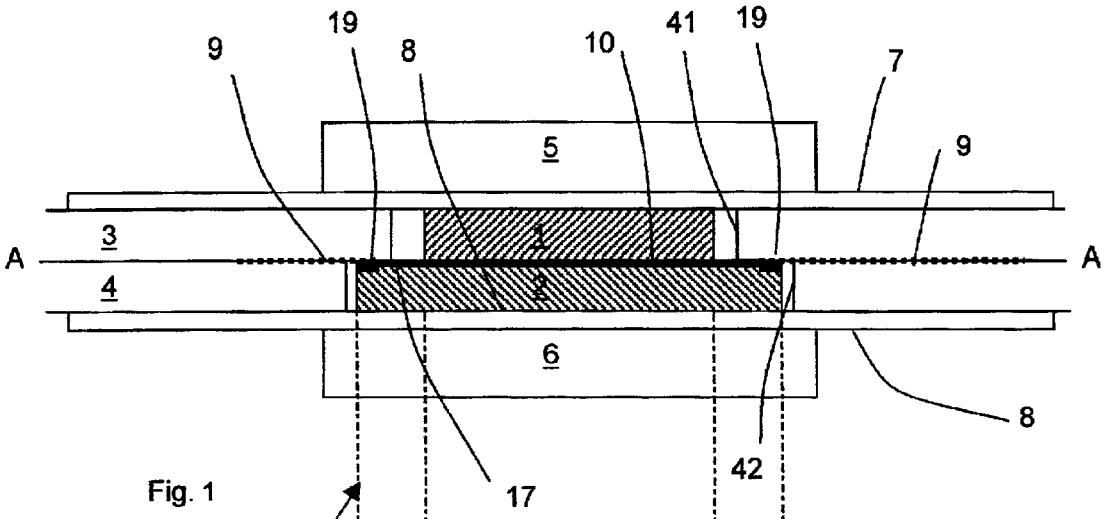
Fig. 1
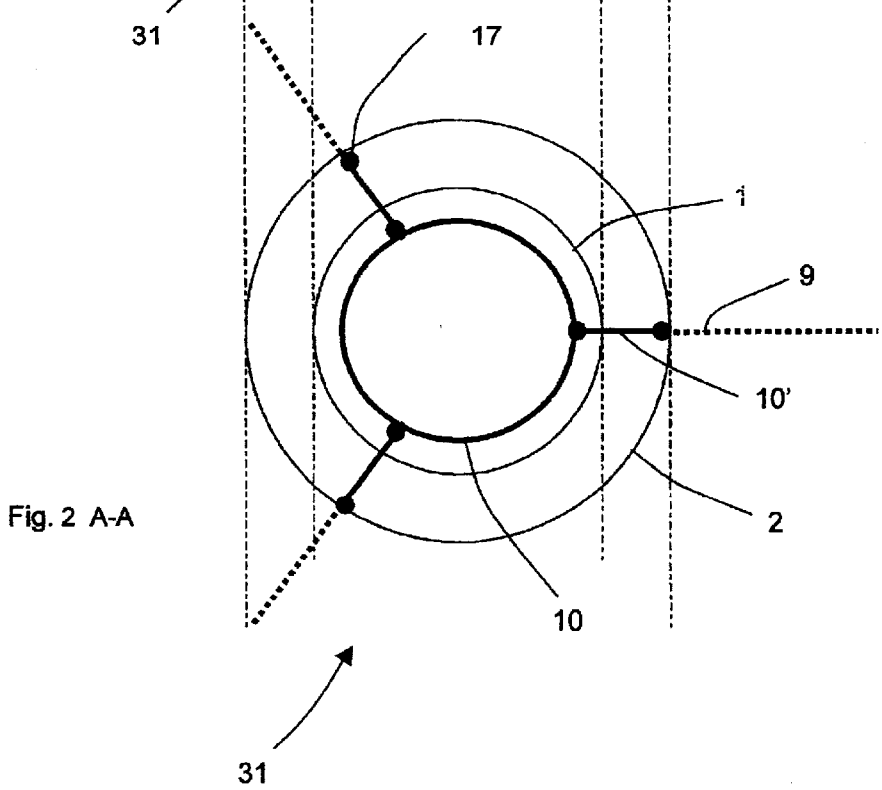
Fig. 2 A-A

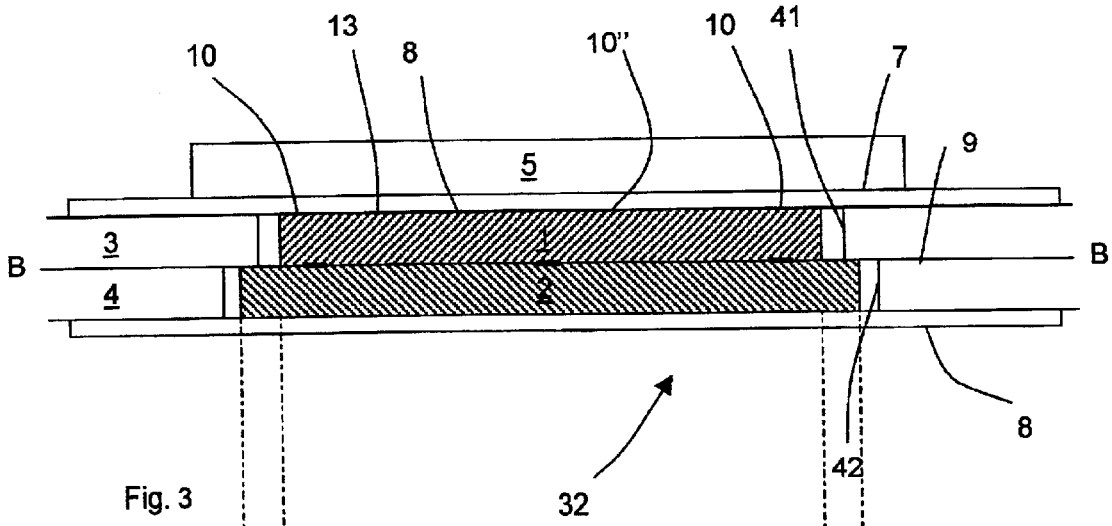
Fig. 3
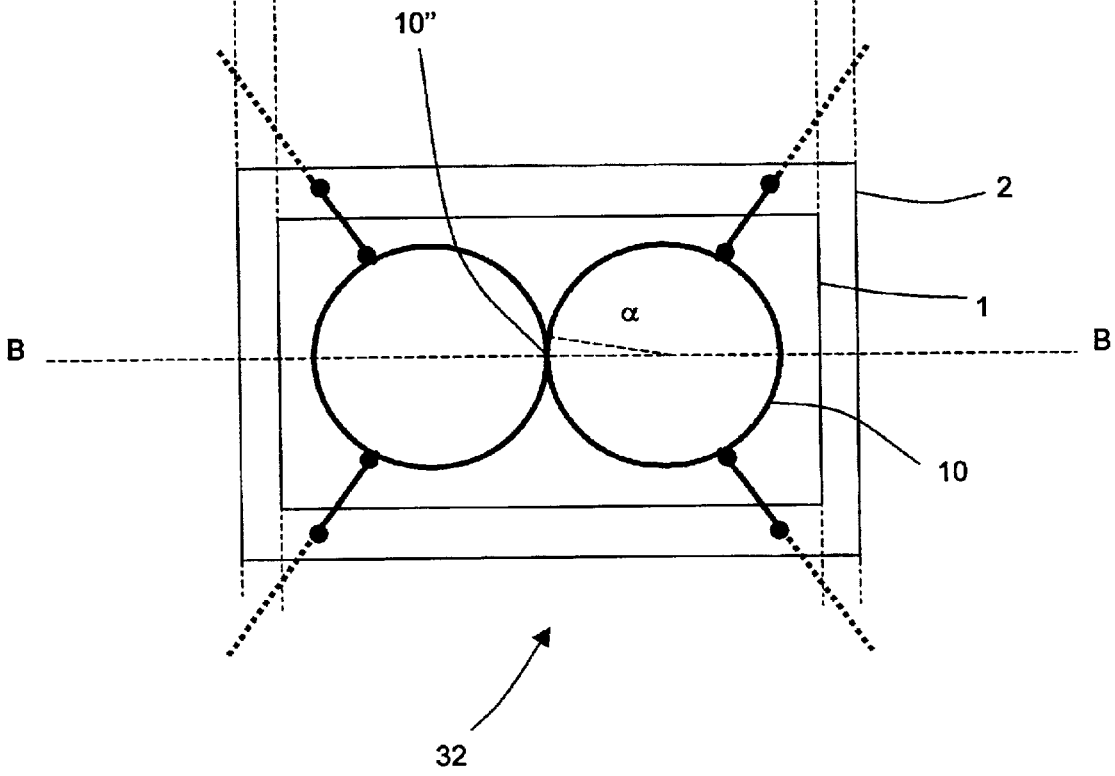
Fig. 4 B-B

CIRCULATOR AND NETWORK

FIELD OF THE INVENTION

The present invention relates to circulators and isolators.

BACKGROUND OF THE INVENTION

Ferrite circulators are for instance used in microwave applications in order to separate incoming and outgoing signals. They are also used as isolators, switches and phase shifters. The functionality of the circulator has been described for instance in the following articles: "On the principle of stripline circulation", by H. Bosma, The Institution of Electrical Engineers, No. 3689, Jan 1962; "Operation of the Ferrite junction Circulator" by C. E. Fay and R. L. Comstock, IEEE transactions on microwave theory and techniques, Jan. 1965; and "Wide Band Operation of Microstrip Circulators", Y. S. Wu and F. Rosenbaum, IEEE transactions on microwave theory and techniques, Vol. MTT-22, No. 10, Oct. 1974.

Circulators having three ports disposed with 120° between them show particular beneficial properties. Therefore, if a higher number of ports than three is needed, a plurality of such three-port circulators are typically interconnected.

Prior art document U.S. Pat. No. 5,347,241 discloses a four port circulator comprising two coaxially arranged three port circulators. The three port circulators are formed on a combination of ferrite and ceramic substrates having a conductive strip layer printed thereon. One embodiment includes a common magnet providing magnetic field through the circulators. Another embodiment comprises two magnets arranged on each side of a magnetic shielded carrier providing magnetic fields through the circulators. The above circulator is useful for wide-band active array antennas.

FIG. 6 of the present application is a representation of U.S. Pat. No. 5,347,241 in which a four port circulator is used as a protection device for a transmit and receive module (TRM) for a radar system.

Prior art document JP-A-09289403 shows a microwave circulator formed by a ferrite substrate and by two magnets being arranged on opposite sides of the substrate.

Prior art document WO-0 079 845 shows a multi-layer circuit board that is arranged as a dual symmetrical strip line configuration whereby top and bottom ground planes enclose the substrate layers as well as a centre ground plane. Among the three ground planes, two signal strip layers are provided. Thereby, microwave emissions can be kept at a minimum. The substrate layers are provided with apertures with an increasing diameter from bottom to top for accommodating the insertion of components in the substrate within the shielded area, whereby two components can be inserted above one another. One component is arranged on the shoulders that are formed by the differently sized apertures. The components are electrically connected to micro strips on the circuit layers by wire bonding.

Prior art document EP-0 996 188 shows a transmit circuit, a receive circuit and a circulator being formed on a Monolithic Microwave Integrated Circuit (MMIC) substrate in strip line configuration, whereby the circulator comprises a ferrite element being embedded or mounted on the MMIC substrate. As ferrite element, Sr/Br magnetoplumbite hard ferrite is proposed, whereby an external magnet is not needed due to the self-coercive force of this material. The size of the apparatus is thereby reduced. However, the above self-coercive materials are not adapted for high power applications.

Prior art document U.S. Pat. No. 4,058,780 shows a four port circulator being formed by two interconnected rectangular port hollow tube circulators being arranged adjacent to one another in the same plane and being interconnected by a common port. Each circulator is provided with a gyromagnetic cylindrical element providing for the non-reciprocal circulation.

SUMMARY OF THE INVENTION

It is a primary object of the present invention to provide a circulator unit which is compact and shielded and which can be integrated in or easily coupled to circuits comprising monolithic microwave integrated circuit (MMIC) devices which are produced with usual microwave circuit production means.

This object has been accomplished by the subject matter defined by claim 1.

It is a further object to provide a circulator unit, which is easily manufactured.

This object has been accomplished by the subject matter of claim 2.

It is another objet to provide a circulator, which allows for strip-line configuration.

This object has been accomplished by claim 3.

It is a further object to provide a circulator that has strong and inflexible structure and which furthermore can be produced very cost efficiently.

This object has also been accomplished by the subject matter of claim 3.

It is another object to provide a circulator network, which for instance may be used for a phase array antenna.

This object has been accomplished especially by the subject matter according to claims 6, 7 and 10.

Further advantages will appear from the following detailed description of the invention.

BRIEF DESCRIPTION OF THE DRAWINGS

FIG. 1 shows a side-view of a first embodiment of a three port circulator unit according to the invention, FIG. 2 shows a cross section along lines A—A of FIG. 1, FIG. 3 shows a cross-section of a first embodiment of a four port circulator unit according to the invention, FIG. 4 shows a cross section along lines B—B of FIG. 3.

DETAILED DESCRIPTION OF PREFERRED EMBODIMENTS OF THE INVENTION

Figure 5:
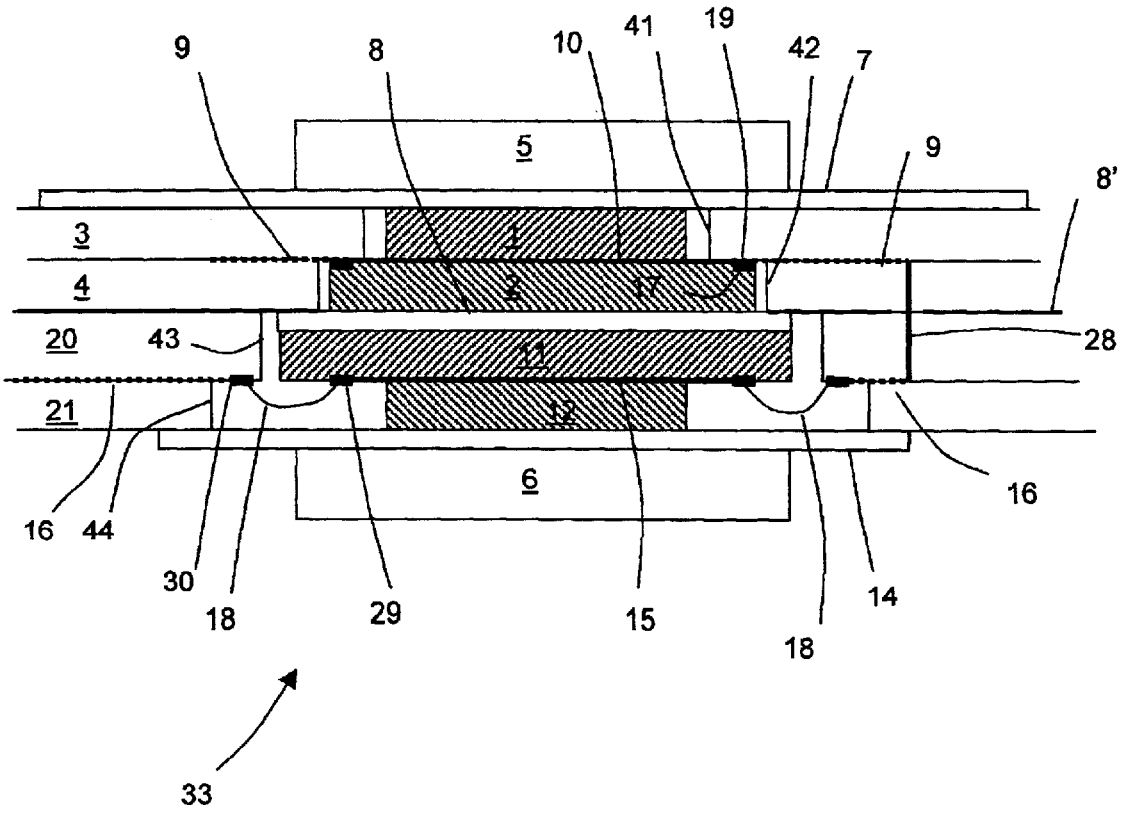
FIG. 5 shows a side-view of a second embodiment of a four port circulator unit according to the invention.

In FIGS. 1 and 2, a three port strip-line circulator according to the invention has been shown. The circulator comprises a first member 1 and a second member 2 both being of ferro-electric material. The first and the second member are arranged adjacent to one another, and are arranged in a dielectric substrate having a first and a second layer.

$Al_3$ ceramics or $SiO_2$ may for instance be used as substrate material.

The first dielectric layer 3 is provided with a first aperture 41 for receiving the first member and is provided with conductive strips 9 and a first set of terminals 17.

As especially appears from FIG. 2, a conductive circulator pattern 10 is printed on the second member. The circulator pattern shows a second set of terminals 19.

The second dielectric layer 4 has a second aperture 42 being arranged over and being larger than the first aperture 41 such that the first member 1 can pass through the second aperture 42. In the present case the first and the second members are cylindrical and the first and the second apertures have circular cross sections.

The second aperture is receiving the second member 2, whereby the conductive first set of terminals 17 of the first substrate layer are connected to the second set of terminals on the second member. Preferably, this connection is accomplished by a conductive attachment such as conductive glue or solder but the respective terminals could also be placed in direct connection.

The strip line design comprises first 7 and second ground 8 conductors arranged on each side of the substrate layers and first and second members. Thereby, an electrically shielded package is accomplished.

Advantageously the first and second members are of the same thickness and same material. The same applies to the first and second substrates. Thereby, the first and second members, first and second ground conductors, and circulator pattern are forming a strip line circuit.

However, a different thickness could be used, especially when the first and the second members have the same dielectric values as seen from the circulator pattern to each respective ground layer 7, 8.

In order to expose the first and second ferro-electric members to the required B-field, the device furthermore comprises two magnets 5, 6. Moreover, a single magnet could be used. Alternatively, a coil could be used for providing a magnetic field through the first and second member.

As appears from the figures, a very compact design has been accomplished. As can be understood the three port circulator unit can be provided in a substrate structure carrying other components such as other circulators. Thereby, cost efficient manufacturing is accomplished.

The first and the second member could have other shapes than the circular cross section shown in FIG. 2. For instance, a triangular cross section or regular polygonal cross sections can be envisaged.

FIGS. 3–4

In FIGS. 3 and 4, a rectangular shape has been used for the first and second members and the corresponding apertures in the first and second substrate layers. Advantageously, the first and second ferro-electric members are sintered into the desired rectangular shape. The circulator unit 32 shows a circulator pattern 10 comprising two interconnected circulators with 120 degree disposed legs arranged adjacent to one another, whereby a common port is formed by the intersection 10" of the two circular patterns. The extension of the intersection as denoted by the angle $\alpha$ is formed to match a specific impedance. Thereby, a compact four port circulator is formed.

The embodiment shown in FIGS. 3 and 4 and the embodiment shown in FIGS. 1 and 2 have a number of features in common. Those features are denoted by the same reference numerals and are described above.

In the embodiment shown in FIGS. 3 and 4, only one magnet 5 is used for providing the B-field through the ferro electric members.

FIGS. 5–6

Figure 6:
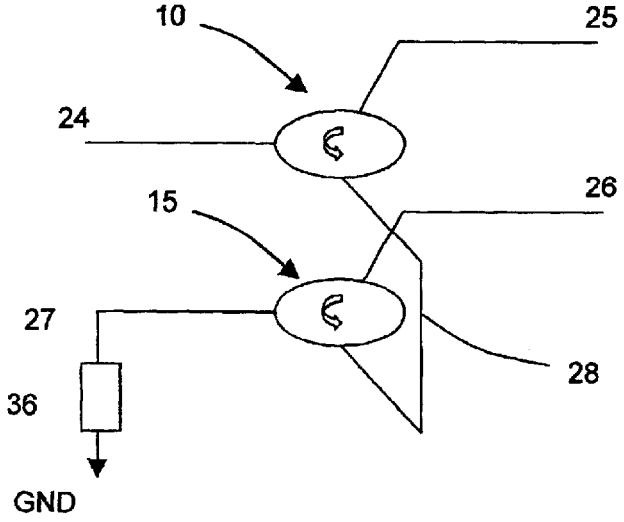
FIG. 6 shows a coupling scheme for a T/R module.

In FIGS. 5 and 6, another embodiment 33 of a four port circulator unit according to the invention has been shown. The first and the second ferro-electric members, 1 and 2, the first 3 and the second 4 substrate layers and the first 41 and second 42 apertures and also the first 9 and the second strip 10 circuits and means for connection are the same as in the three port circulator of FIG. 1. Likewise, a pair of magnets 5, 6 are provided on each side of the structure as is a pair of ground conductors, 7 and 8, shielding the first 1 and the second 2 members and providing the strip line structure for the first and second conductive patterns.

However, as appears from FIG. 5, the ground conductor 8 has a shorter extension and third and fourth substrate layers 20, 21 and third and forth members 11, 12 are provided such that two circulators are arranged in a sandwich structure.

The third member 11 and the fourth member 12—both of ferro-electric material—are arranged adjacent to one another. The third dielectric layer 20 is provided having a third aperture 43 that is arranged over the second aperture 42 and is of such size that at least the second member 2 can pass through the second aperture 42 and for receiving the third member 11.

The second ground conductor 8 is arranged between the second 2 and the third 12 member. The ground conductor 8 is connected to ground pattern 8'. Alternatively, a ground pattern may be printed on the third member 11 for providing a ground plane.

A third conductive circulator strip circuit 15 is printed on the third member 11 and is arranged between the third and the fourth member, the third circulator strip circuit having a third set of terminals 29.

The third dielectric layer 20 has a fourth conductive strip circuit 16 and a fourth set of terminals 30.

The fourth dielectric layer 21 has a fourth aperture 44 being arranged over the first aperture 41 such that the first 1, second 2 and third 11 member can pass through the fourth aperture 44, and the fourth member 12 is received in the fourth aperture 44, the fourth terminals 30 being accessible in the fourth aperture 44.

The third 29 and fourth set of terminals 30 are connected by a connection means 18, preferably wire bonding, and a third ground conductor 14 is arranged opposite the second ground conductor 8, such that the third 11 and the fourth member 12 are arranged between the second 8 and the third 14 ground conductor.

A single magnet could be used, although the magnetic field would be somewhat inhomogeneous having regard to the various members 1, 2, 11 and 12.

The circulators are connected by a via 28 in the manner shown in FIG. 6.

The circulator unit may for instance be used between an array antenna 24 and a transmit 25/receive 56 module.

Figure 7:
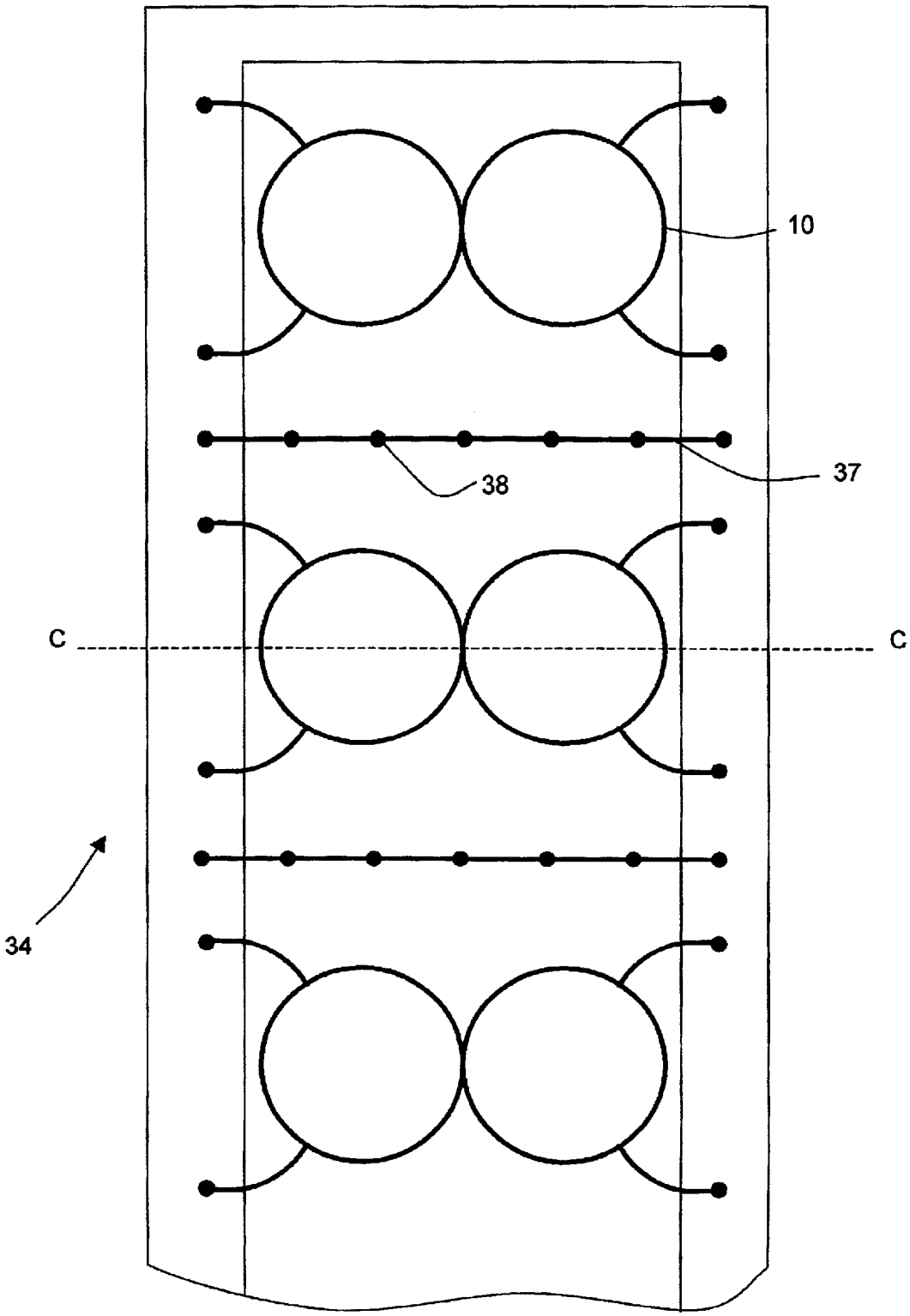
FIG. 7 shows a circulator network based on units similar to those shown in FIGS. 3 and 4.
Figure 8:
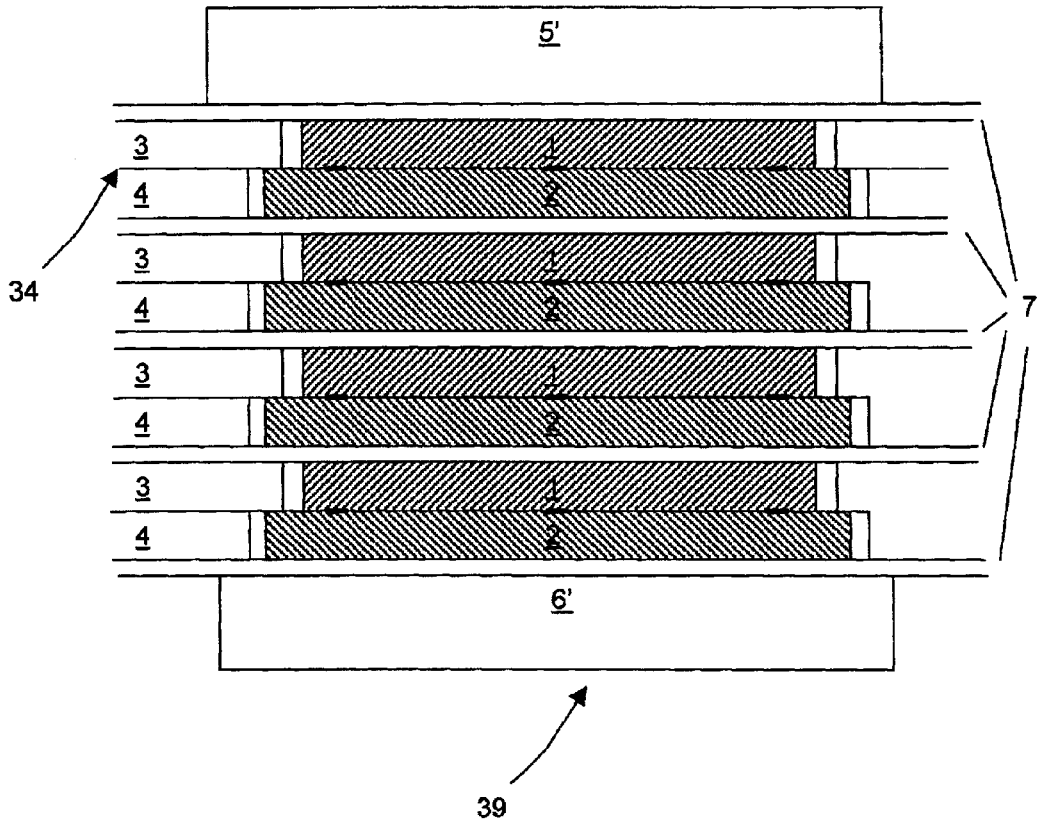
FIG. 8 shows a network of stacked circulator units along line C—C of FIG. 7.

FIGS. 7 and 8

FIGS. 7 and 8 shows a stack 39 of network layers 34 comprising a circulator unit similar to the structure shown in FIG. 4 but comprising a plurality of non interconnected circulator patterns. As appears from FIG. 7, a number of shield strips with shield vias 38 have been provided for providing a shielded grid between the circulator units. The shield vias may be distributed with ⅛ of the operating wavelength for providing shielding.

As appears from FIG. 8 the structure comprises many layers, which are mounted close together. The outer magnets 5' and 6' are thicker and thus provide a stronger field than the magnets 5 and 6 shown in the previous figures, since the structure is thicker. When the thickness increases, it may be necessary to interpose magnets in the structure between some circulator units. Advantageously, the individual layers may be mounted in such a manner that the network can be disassembled should one element fail in the network. For instance the layers may be bolted together, whereby a network layer 34 can be replaced.

The above circulator network is especially suitable for phase array antennas with multiple antenna elements because of the compact construction.

FIG. 9

Figure 9:
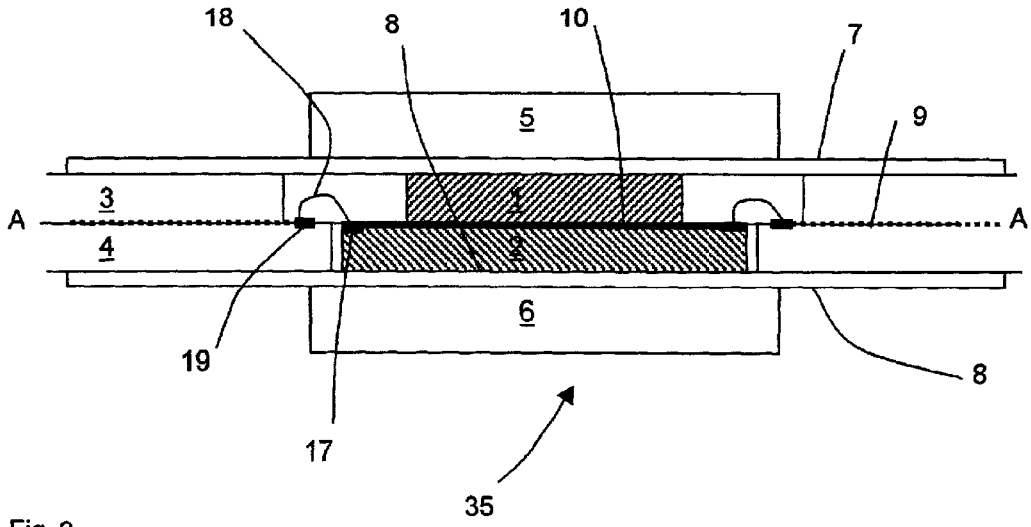
FIG. 9 shows a second embodiment of a two port circulator.

FIG. 9 shows a second embodiment of a three port circulator. The structure differs from the circulator unit of FIG. 1, in that bonding wires are used as a means of coupling the first and second set of terminals. For this reason, the second substrate is provided with the second set of terminals and the second member is provided with the circulator pattern and first set of terminals.

Reference Signs

1 first member
2 second member
3 first substrate layer
4 second substrate layer
5 first magnet
5' top magnet
6 second magnet
6' bottom magnet
7 first ground conductor
8 second ground conductor
8' ground pattern
9 first strip circuit
10 second strip circuit
10' leg
10" intersection
11 third member
12 fourth member
14 third ground conductor
15 third strip circuit
16 fourth strip circuit
17 first set of terminals
18 connection means
19 second set of terminals
20 third substrate layer
21 fourth substrate layer
23 third set of terminals
24 antenna port
25 transmit port
26 receive port
27 ground
28 via
29 third set of terminals
30 fourth set of terminals
31 first circulator unit
32 second circulator unit
33 third circulator unit
34 circulator network
35 fourth circulator unit
36 resistor
37 shield strips
38 shield via
39 stack
41 first aperture
42 second aperture
43 third aperture
44 fourth aperture

What is claimed is:

1. A circulator unit comprising:

a first member and a second member both being of ferro-electric material and arranged adjacent to one another;

a conductive circulator pattern printed on the first or second member and arranged between the first and the second member, the circulator pattern having a first set of terminals;

a first dielectric layer having a first aperture receiving the first member;

a second dielectric layer having a second aperture receiving the second member;

conductive strips and a second set of terminals being arranged on the first or second dielectric layer;

wherein the second member extends beyond the first member on an area where the second set of terminals are provided rendering the second set of terminals accessible;

wherein the first dielectric layer extends beyond the second dielectric layer, or vice versa, on an area where the first set of terminals are provided rendering the first set of terminals accessible;

first and second ground conductors arranged on each side of the first and second members; and at least one device for providing a magnetic field through the first and second member.

2. The circulator unit according to claim 1 wherein the second aperture is arranged over the first aperture and sized such that the first member can pass through the second aperture.

3. The circulator unit according to claim 1 wherein the first dielectric layer is provided with the second set of terminals, and the second member is provided with the circulator pattern and first set of terminals, the edge of the second member resting on the edge of the first dielectric layer such that respective terminals of the circulator pattern are connected to respective terminals of the second set of terminals.

4. The circulator unit according to claim 3 wherein the first and the second set of terminals are connected by electrically conductive glue.

5. Circulator unit according to claim 1, whereby the second substrate is being provided with the second set of terminals and the second member is being provided with the circulator pattern and first set of terminals, the respective terminals of the first set and second set of terminals being connected by a connection means.

6. Circulator unit according to claim 1, whereby the circulator pattern comprises two or more interconnected three port circulator patterns.

7. Circulator unit according to claim 1, comprising a plurality of non interconnected circulator patterns being provided on the same first or second member.

8. The circulator unit according to claim 1 wherein the conductive strips, the conductive circulator pattern, and the first and second ground conductors form a strip-line circuit.

9. The circulator unit of claim 8, wherein:

the first and second members are constructed of the same ferro-electric material, and the thickness of the first member is equal to the thickness of the second member; and the first and second dielectric layers are constructed of the same material, and the thickness of the first dielectric layer is equal to the thickness of the second dielectric layer.

10. The circulator unit of claim 8, wherein the thickness of the first member is not equal to the thickness of the second member, but dielectric values of the first member and the second member are equal, as measured from the circulator pattern to each respective ground conductor.

11. The circulator unit of claim 1, wherein the at least one device for providing a magnetic field comprises a magnet.

12. The circulator unit of claim 1, wherein the at least one device for providing a magnetic field comprises a coil.

13. The circulator unit of claim 1, wherein the at least one device for providing a magnetic field comprises first and second magnets arranged on each side of the first and second ground conductors.

14. Circulator unit according to claim 1, comprising:

a third member and a fourth member both being of ferro-electric material and arranged adjacent to one another, a third dielectric layer having a third aperture being arranged over the second aperture and of such size that at least the second member can pass through the second aperture and for receiving the third member;

the second ground conductor being arranged between the second and the third member;

a third conductive circulator strip circuit printed on the third member and arranged between the third and the fourth member, the third circulator strip circuit having a third set of terminals;

the third dielectric layer having a fourth conductive strip circuit and a fourth set of terminals;

a fourth dielectric layer having a fourth aperture being arranged over the first aperture such that the first, second and third member can pass through the fourth aperture, and the fourth member is received in the fourth aperture, the fourth terminals being accessible in the fourth aperture;

the third and fourth set of terminals being connected by a connection means; and a third ground conductor being arranged opposite the second ground conductor, such that the third and the fourth member are arranged between the second and the third ground conductor.

15. Circulator network of claim 1 further comprising a stack of circulator units.

16. The circulator unit of claim 1, wherein the conductive circulator pattern is circular.

17. The circulator unit of claim 1, wherein the conductive circulator pattern is triangular.

* * * * *